US009216873B2

(12) United States Patent
Takemasa et al.

(10) Patent No.: US 9,216,873 B2
(45) Date of Patent: Dec. 22, 2015

(54) SHEET STACKING APPARATUS AND SHEET PROCESSING APPARATUS AS WELL AS IMAGE FORMING APPARATUS

(71) Applicant: CANON KABUSHIKI KAISHA, Tokyo (JP)

(72) Inventors: Rikiya Takemasa, Toride (JP); Yusuke Obuchi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/586,011

(22) Filed: Dec. 30, 2014

(65) Prior Publication Data

US 2015/0108712 A1 Apr. 23, 2015

Related U.S. Application Data

(62) Division of application No. 13/903,100, filed on May 28, 2013, now Pat. No. 8,950,746.

(30) Foreign Application Priority Data

Jun. 25, 2012 (JP) ..... 2012-142189

(51) Int. Cl.
*B65H 33/08* (2006.01)
*B65H 33/06* (2006.01)
(Continued)

(52) U.S. Cl.
CPC ..... *B65H 33/06* (2013.01); *B42C 1/125* (2013.01); *B65H 29/00* (2013.01); *B65H 29/66* (2013.01);
(Continued)

(58) Field of Classification Search
CPC ..... G03G 15/6547; G03G 2215/0089; B65H 33/08
USPC ..... 399/404; 271/240
See application file for complete search history.

(56) References Cited

U.S. PATENT DOCUMENTS 6,085,913 A 7/2000 Aiko et al.
6,361,042 B1 3/2002 Shimura et al.
(Continued)

FOREIGN PATENT DOCUMENTS

JP 2009-007151 A 1/2009
JP 2009-227438 A 10/2009
WO 2011/047980 A1 4/2011

OTHER PUBLICATIONS

U.S. Appl. No. 13/927,618, filed Jun. 26, 2013.
(Continued)

*Primary Examiner* — Jeremy R Severson
(74) *Attorney, Agent, or Firm* — Fitzpatrick, Cella, Harper & Scinto

(57) ABSTRACT

Disclosed is a sheet processing apparatus including an intermediate processing tray on which a sheet conveyed by a discharge roller is stacked, a proximal aligning plate and a distal aligning plate moving in a sheet width direction for aligning the sheet conveyed onto the intermediate processing tray, and a finisher controller for moving and controlling the proximal aligning plate and the distal aligning plate to align, when a sheet having a length in the sheet conveyance direction shorter than a predetermined length in the sheet conveyance direction is conveyed, the sheet at a position shifted nearer to a take-out port side A in the sheet width direction than a position in the sheet width direction at which a sheet having a length in the sheet conveyance direction equal to or more than the predetermined length in the sheet conveyance direction is aligned.

23 Claims, 13 Drawing Sheets

(51) Int. Cl.

| | |
|---|---|
| ***B65H 29/00*** | (2006.01) |
| ***B65H 31/30*** | (2006.01) |
| ***B65H 37/04*** | (2006.01) |
| ***B65H 39/10*** | (2006.01) |
| ***B42C 1/12*** | (2006.01) |
| ***B65H 31/00*** | (2006.01) |
| ***B65H 29/66*** | (2006.01) |
| ***B65H 31/26*** | (2006.01) |
| ***B65H 31/34*** | (2006.01) |
| ***B65H 43/04*** | (2006.01) |

(52) U.S. Cl.

CPC ..... *B65H 31/00* (2013.01); *B65H 31/26* (2013.01); *B65H 31/3027* (2013.01); *B65H 31/34* (2013.01); *B65H 33/08* (2013.01); *B65H 37/04* (2013.01); *B65H 39/10* (2013.01); *B65H 43/04* (2013.01); *B65H 2301/4219* (2013.01); *B65H 2301/51611* (2013.01); *B65H 2511/11* (2013.01); *B65H 2511/20* (2013.01); *B65H 2801/27* (2013.01)

(56) References Cited

U.S. PATENT DOCUMENTS

| | | | | |
|---|---|---|---|---|
| 7,259,877 | B2 | 8/2007 | Inoo et al. | |
| 8,387,966 | B2 | 3/2013 | Dinnissen | |
| 8,672,313 | B2 * | 3/2014 | Fukami | 270/58.09 |
| 8,950,746 | B2 * | 2/2015 | Takemasa et al. | 271/240 |
| 2003/0085511 | A1 | 5/2003 | Saito et al. | |
| 2008/0006993 | A1 | 1/2008 | Nomura et al. | |
| 2012/0205854 | A1 | 8/2012 | Dinnissen | |

OTHER PUBLICATIONS

U.S. Appl. No. 13/937,649, filed Jul. 9, 2013.

* cited by examiner

SHEET STACKING APPARATUS AND SHEET PROCESSING APPARATUS AS WELL AS IMAGE FORMING APPARATUS

This is a division of U.S. patent application Ser. No. 13/903,100, filed May 28, 2013.

BACKGROUND OF THE INVENTION

1. Field of the Invention

The invention relates to a sheet stacking apparatus capable of sorting each of a predetermined number of sheets and to a sheet processing apparatus as well as an image forming apparatus each provided with the sheet stacking apparatus.

2. Description of the Related Art

Recently, in an image forming apparatus such as a copying machine, a printer, a facsimile, and the like, there is known an inside discharging type image forming apparatus in which an image reading apparatus is disposed in an upper portion of an image forming apparatus main body and a sheet discharging portion for discharging a sheet is interposed between the image reading apparatus and the image forming apparatus main body. Further, as well as the inside discharging type, there is also known an image forming apparatus in which a sheet processing apparatus for executing a post process such as a staple process, a perforation process, and a sorting process to a sheet discharged to a sheet discharging portion is disposed upstream of the sheet discharging portion so that process performance is improved.

However, in the inside discharging type image forming apparatus, since the sheet discharging portion is disposed between the image reading apparatus and the image forming apparatus main body, when an discharged sheet is visually recognized, an operator must visually recognize his or her own sheet by looking into the sheet discharging portion. Further, when another sheet is discharged onto plural sorted sheets, since a sorted sheet is covered with the other sheet, the operator must visually recognize the sorted sheet by removing the other sheets, for example.

To cope with the problem, there is proposed an inside discharging type image forming apparatus which improves a visual recognition property of a sheet discharged to an discharging portion by discharging the sheet in a state that it is shifted a predetermined distance in a sheet width direction intersecting a sheet discharging direction every predetermined number of sheets (one set) (see Japanese Patent Laid-Open No. 2009-7151).

However, in the image forming apparatus described in Japanese Patent Laid-Open No. 2009-7151, a sheet is shifted and discharged using a reference line on a proximal side (side where the sheet is visually recognized) as a reference regardless of a sheet size. Accordingly, when, for example, an A3 size sheet is discharged after an A4 size sheet has been discharged, since the A4 sheet is covered with the A3 sheet, it becomes difficult for a user who has output the A4 sheet to visually recognize that the A4 sheet exists. Further, since in order to remove or dislocate the A3 sheet on the A4 sheet it is necessary to take out the A4 sheet, ease of sheet removal is also reduced. Furthermore, when, for example, the A3 sheet is in an aligned state, the A3 sheet becomes out of alignment when the user removes and dislocates the A3 sheet to take out the A4 sheet.

It is an advantage of the invention to provide a sheet stacking apparatus which ameliorates the visual recognition property problem and ease of removal of a discharged sheet and an image forming apparatus including the sheet stacking apparatus.

SUMMARY OF THE INVENTION

The invention is characterized in a sheet stacking apparatus which includes a sheet stacking portion on which a sheet conveyed from a sheet conveying portion is stacked and from one end side, in a sheet width direction intersecting a sheet conveyance direction, of which a stacked sheet is taken out, a shift unit for shifting the sheet stacked on the sheet stacking portion in the sheet width direction, and a controller for moving and controlling the shift unit to stack, when a sheet having a length equal to or more than a predetermined length in the sheet conveyance direction is to be stacked on the sheet stacking portion, the sheet at a first position in the sheet width direction and to stack, when a sheet having a length shorter than the predetermined length in the sheet conveyance direction is to be stacked on the sheet stacking portion, the sheet at a second position nearer to the one end side than the first position in the sheet width direction.

Further, the invention is characterized in a sheet processing apparatus which includes a sheet processing portion for processing a sheet, a sheet stacking portion which is stacked with the sheet processed by the sheet processing portion and from one end side, in a sheet width direction intersecting a sheet conveyance direction, of which a stacked sheet is taken out, a pair of alignment members which move in the sheet width direction intersecting the sheet conveyance direction and align a sheet conveyed to the sheet stacking portion in the sheet width direction by sandwiching the sheet therebetween, and a controller for moving and controlling the pair of alignment members to align, when a sheet having a length equal to or more than a predetermined length in the sheet conveyance direction is to be stacked on the sheet stacking portion, the sheet at a first position in the sheet width direction and to align, when a sheet having a length shorter than the predetermined length in the sheet conveyance direction is to be stacked on the sheet stacking portion, the sheet at a second position nearer to the one end side than the first position in the sheet width direction.

According to the invention, a visual recognition property and a take-out property of a discharged sheet can be improved by aligning a sheet having a length in the conveyance direction shorter than the predetermined length in the sheet conveyance direction at a position shifted to a take-out port side.

Further features of the present invention will become apparent from the following description of exemplary embodiments with reference to the attached drawings.

DESCRIPTION OF THE EMBODIMENTS

An image forming apparatus including a sheet processing apparatus according to an embodiment of the invention will be described below referring to drawings. The image forming apparatus according to the embodiment of the invention is an image forming apparatus including a sheet processing apparatus such as a copying machine, a printer, a facsimile, and composite equipment thereof which aligns a sheet on which an image is formed and executes a predetermined post process to the aligned sheet. In the embodiment described below, a description will be made using an inside discharging type image forming apparatus (hereinafter, simply called "image forming apparatus") 1 in which a reading apparatus is disposed to an upper portion of an image forming apparatus main body (hereinafter, simply called "apparatus main body") as the image forming apparatus. Further, a position where a user faces an operation portion 601 via which the user executes various inputs and setting to the image forming apparatus 1 is called "a proximal side" of the image forming apparatus 1 and a back surface side of the image forming apparatus 1 is called "a distal side".

Figure 1:
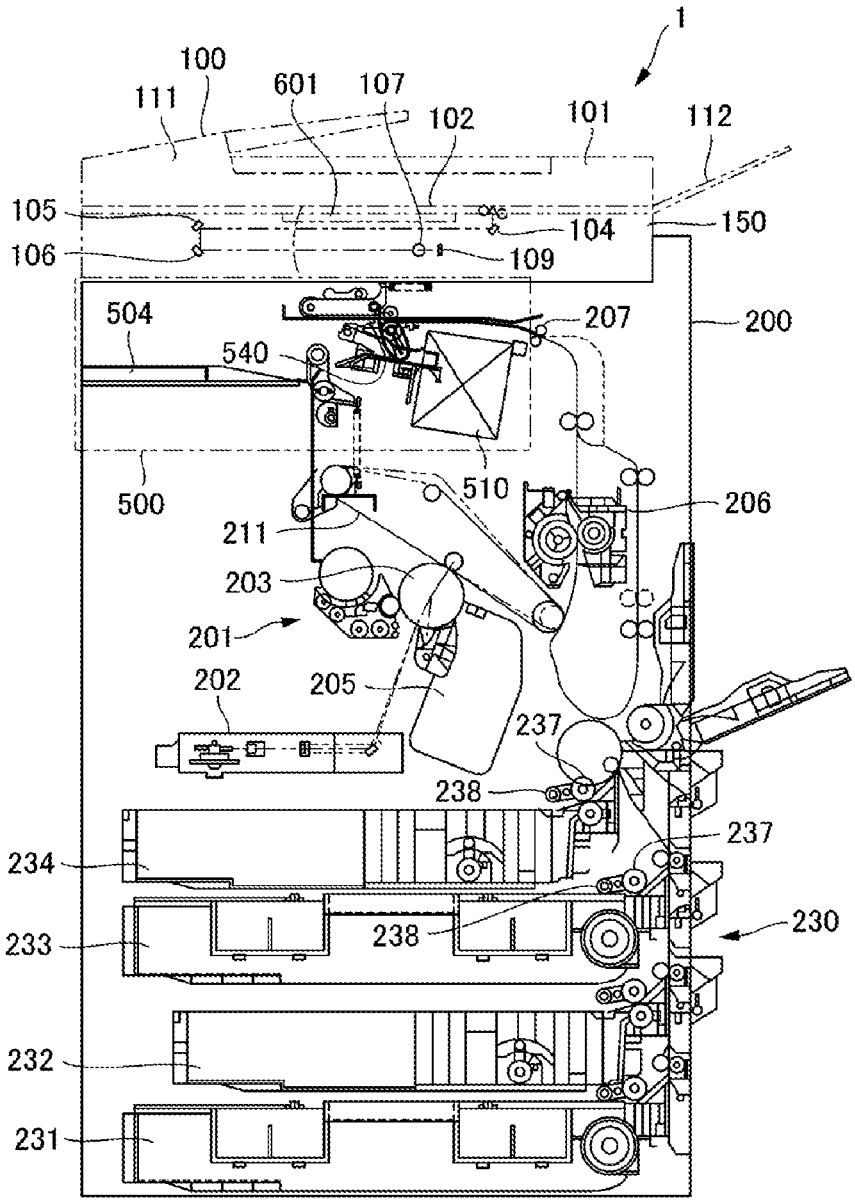
FIG. 1 is a sectional view schematically illustrating an image forming apparatus according to an embodiment of the invention when viewed from a proximal side.

The image forming apparatus 1 according to the embodiment of the invention will be described referring to FIG. 1. FIG. 1 is a sectional view schematically illustrating the image forming apparatus according to the embodiment of the invention when viewed from the proximal side.

As illustrated in FIG. 1, the image forming apparatus 1 includes a reading apparatus 100 for reading an image of an original, an apparatus main body 200 for forming an image on a sheet, and a finisher 500 as a sheet processing apparatus for executing a post process such as a sorting process and the like of a sheet.

The reading apparatus 100 is disposed to an upper portion of the apparatus main body 200 and includes an original feed apparatus 101 for automatically feeding the original and an original read portion 150 for reading the image of the original fed by the original feed apparatus 101. The original feed apparatus 101 includes an original feed portion 111 for feeding the original and a discharge tray 112 to which the original is discharged. The original read portion 150 includes a platen glass 102 on which the original is placed and a scanner unit 104 and an image sensor 109 for reading the image of the original.

The apparatus main body 200 includes an image forming portion 201 for forming an image and a feed portion 230 for feeding a sheet to the image forming portion 201. The image forming portion 201 includes a photosensitive drum 203, an exposing portion 202 for forming an electrostatic latent image on the photosensitive drum 203, and a development device 205 for making the electrostatic latent image formed on the photosensitive drum 203 visible. The feed portion 230 includes cassettes 231 to 234 in which sheets are accommodated, a pick-up roller 238 for feeding the accommodated sheets, and a separation portion 237 for separating the fed sheets one by one.

Originals set to the original feed portion 111 are fed sequentially one by one from a top page and conveyed onto the platen glass 102 via a curved convey path. An original conveyed onto the platen glass 102 is irradiated by a lamp of the scanner unit 104 and an image is read by guiding light reflected from the original to the image sensor 109 via a first mirror 105, a second mirror 106, and a lens 107. The original from which the image is read is discharged to the discharge tray 112.

The image of the original read by the image sensor 109 is subjected to an image process and fed to the exposing portion 202, and a laser beam is emitted to the photosensitive drum 203 whose surface is uniformly charged. The laser beam is reflected by a polygon mirror being rotated and further reflected by a reflection mirror and irradiated to the photosensitive drum 203. The laser beam irradiated to the photosensitive drum 203 forms an electrostatic latent image on the photosensitive drum 203, and the latent image is developed by the development device 205.

In parallel with the image forming operation described above, sheets fed from the pick-up roller 238 are selectively fed out from cassettes 231 to 234 while being separated one by one by the separation portion 237 and fed to a transfer position in synchronization with a rotation of the photosensitive drum 203. At the transfer position, a toner image formed on the photosensitive drum 203 is transferred onto a sheet via a transfer belt 211.

Thereafter, the sheet having the toner image transferred thereon is conveyed to a pair of fixing rollers 206 and subjected to a heating and pressurizing process thereby, so that the toner image is fixed. The sheet having the toner image fixed thereon is guided to the finisher 500 by a pair of discharge rollers 207.

Figure 2:
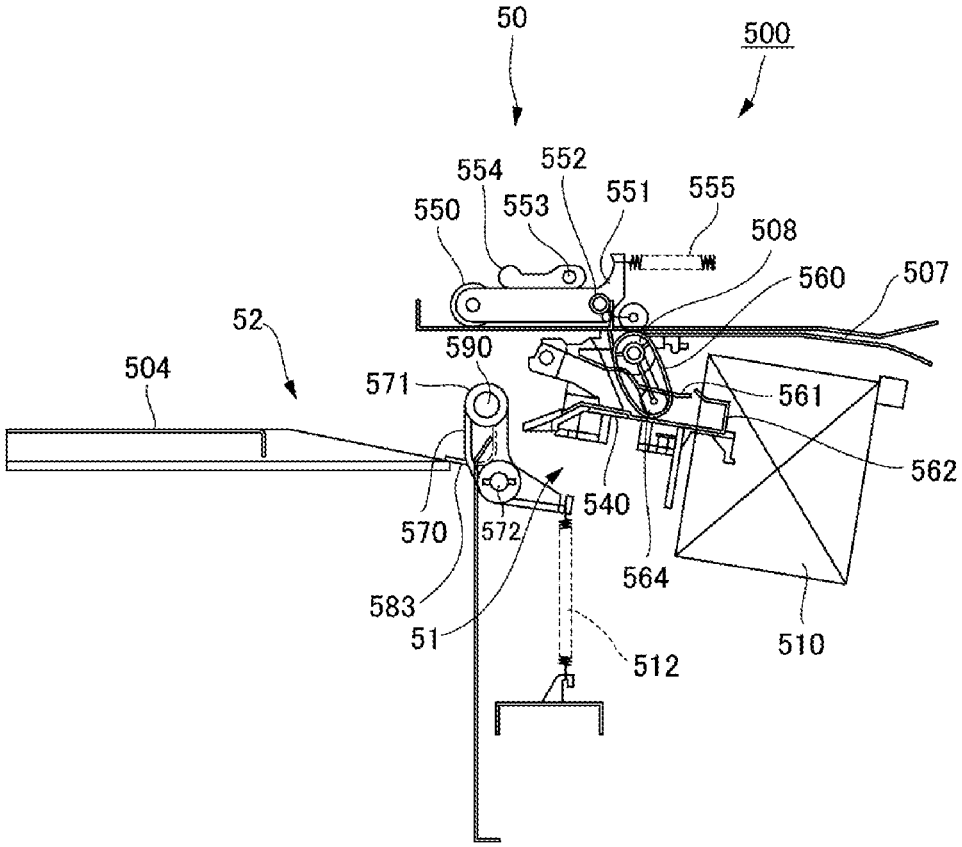
FIG. 2 is a sectional view schematically illustrating a finisher according to the embodiment.
Figure 3:
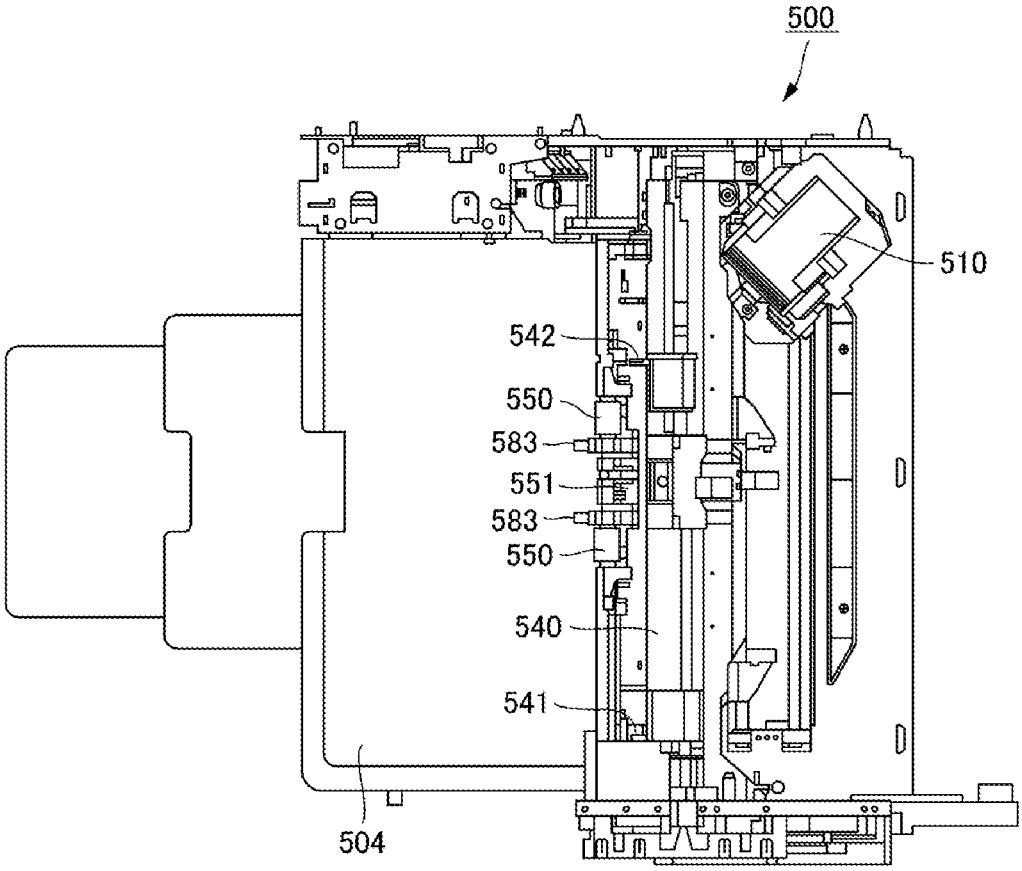
FIG. 3 is a plan view schematically illustrating the finisher according to the embodiment.

Next, the finisher 500 will be described referring to FIG. 2 and FIG. 3 in addition to FIG. 1. FIG. 2 is a sectional view schematically illustrating the finisher 500 according to the embodiment. FIG. 3 is a plan view schematically illustrating the finisher according to the embodiment.

As illustrated in FIG. 2 and FIG. 3, the finisher 500 includes a discharge roller 508 as a sheet conveying portion for conveying a sheet, a rocking guide portion 50 for rocking and guiding the sheet conveyed by the discharge roller 508, and a sheet processing portion 51 for executing a post process of the sheet. Further, the finisher 500 includes a stacking portion 52 for stacking an aligned sheet.

As illustrated in FIG. 1 and FIG. 2, the discharge roller 508 is disposed to a conveying path 507 connected to the apparatus main body 200 and conveys the sheet guided inside of the finisher 500 by the pair of discharge rollers 207 of the apparatus main body 200. The discharge roller 508 is driven by and coupled with a conveying motor M750 (FIG. 5) and a drive of the conveying motor M750 is controlled based on a sheet detected by a sheet position detecting sensor S770 (FIG. 5) disposed to the conveying path 507.

The rocking guide portion 50 includes a rocking arm 551, a rocking cam 554, and a rocking roller 550. The rocking arm 551 is disposed above the conveying path 507 on a downstream side of the discharge roller 508 in a sheet conveyance direction (hereinafter, simply called "downstream") and supported rockably up and down about a rocking shaft 552. Further, the rocking arm 551 is attached with a tension spring 555 which urges the rocking arm 551 upward and assists the rocking arm 551 that rocks downward to rock upward.

The rocking cam 554 is disposed above the rocking arm 551 and supported rockably up and down about a cam shaft 553. Further, the cam shaft 553 of the rocking cam 554 is driven by and coupled with a rocking arm drive motor M751 (FIG. 5), and driving the rocking arm drive motor M751 causes the rocking cam 554 to rock in an up-down direction about the cam shaft 553. Rocking the rocking cam 554 in the up-down direction causes the rocking arm 551 disposed therebelow to be pushed by the rocking cam 554 and to rock down.

Figure 5:
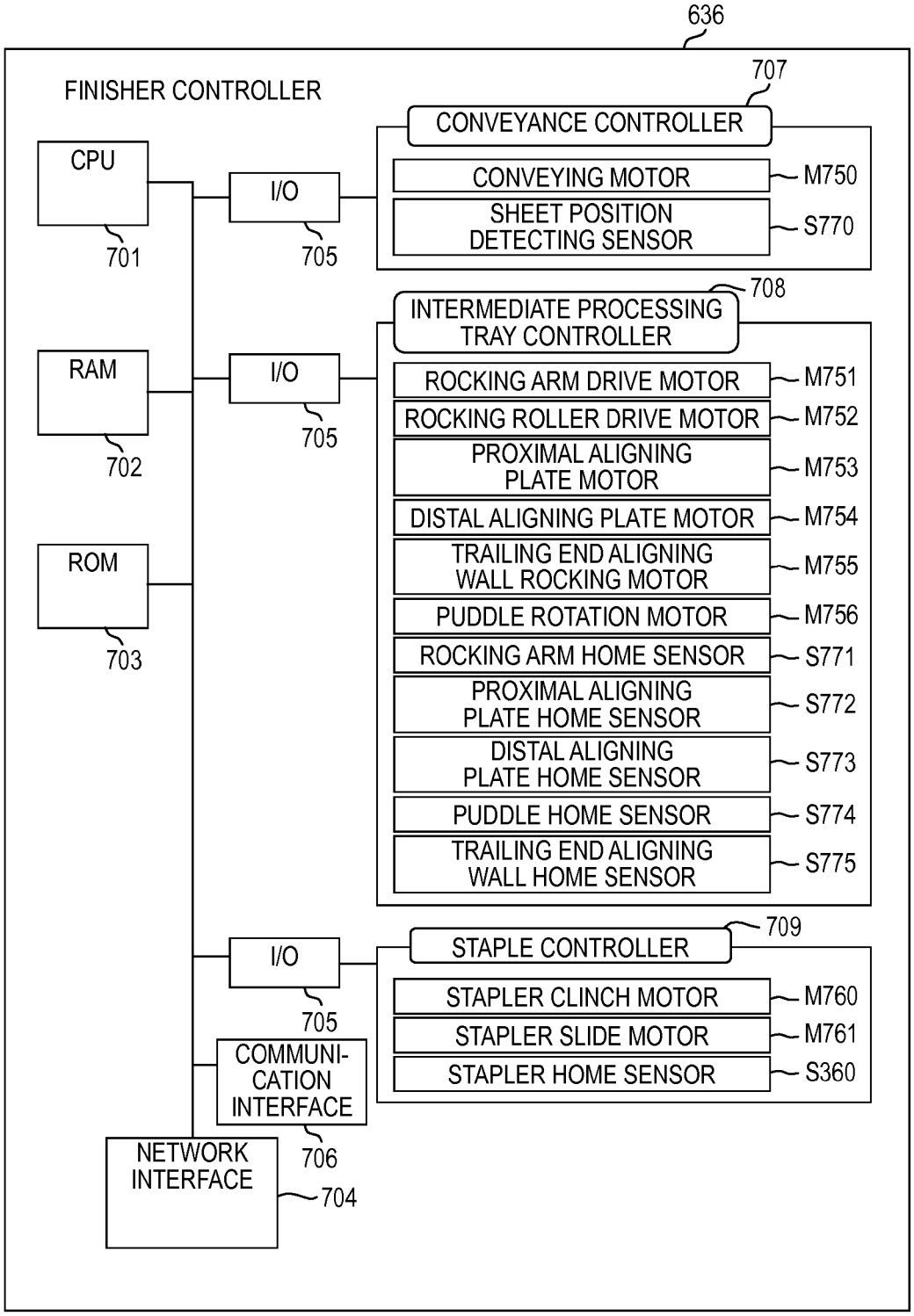
FIG. 5 is a block diagram of a finisher controller for controlling the finisher according to the embodiment.

The rocking roller 550 is rotatably supported by a leading end of the rocking arm 551. The rocking roller 550 is driven by and coupled with a rocking roller drive motor M752 (FIG. 5) via a drive belt and a driven pulley, any of which is not illustrated, and is rotated by driving the rocking roller drive motor M752. Further, the rocking roller 550 uses a position above the conveying path 507 which is not in touch with a sheet discharged by the discharge roller 508 as a home position which is detected by a rocking arm home sensor S771 (FIG. 5).

The sheet processing portion 51 includes an intermediate processing tray 540, a return belt 560, a trailing end stopper 562, a proximal aligning plate 541 and a distal aligning plate 542 as a pair of alignment members, and a stapler unit 510. Note that, in the embodiment, the intermediate processing tray 540, the proximal aligning plate 541, and the distal aligning plate 542 constitute a sheet stacking apparatus. The proximal aligning plate 541 and the distal aligning plate 542 can move in the sheet width direction orthogonal to the sheet conveyance direction and aligns a sheet by sandwiching it therebetween as well as have a function as a shift unit for shifting a sheet to a predetermined position in the sheet width direction. Note that, in the embodiment, although the proximal aligning plate 541 and the distal aligning plate 542 are described as the shift unit, there is also a shift unit for moving, for example, a pair of rollers while the rollers are conveying (discharging) a sheet or moving a stack tray before a sheet is stacked thereon in the sheet width direction as other shift unit.

The intermediate processing tray 540 is disposed below the discharge roller 508 and temporarily stacks a sheet that has been discharged from the discharge roller 508 and is to be subjected to the post process. The return belt 560 is stretched around a rotating shaft of the discharge roller 508 and a pulley 564 and rotates in contact with the sheet stacked on the intermediate processing tray 540 to thereby convey the sheet to an upstream side in the sheet conveyance direction (hereinafter, simply called "upstream side"). Further, the return belt 560 can be offset in a sheet thickness direction in response to the number of sheets stacked on the intermediate processing tray 540. The trailing end stopper 562 is disposed to an end portion of the intermediate processing tray 540 on the upstream side thereof and causes an upstream end of a sheet in the sheet conveyance direction (hereinafter, simply called "upstream end"), which is conveyed to the upstream side, to be abutted against the trailing end stopper 562 by the return belt 560 to thereby align the sheet in the sheet conveyance direction.

As illustrated in FIG. 3, the proximal aligning plate 541 and the distal aligning plate 542 are configured to be free to move on the intermediate processing tray 540 in the sheet width direction intersecting the sheet conveyance direction. Further, the proximal aligning plate 541 is driven by and coupled with a proximal aligning plate motor M753 (FIG. 5) and the distal aligning plate 542 is driven by and coupled with a distal aligning plate motor M754 (FIG. 5), so that a sheet is aligned by pressing both the ends of the sheet in the sheet width direction by an alignment surface capable of pressing both the ends of the sheet in the sheet width direction.

The proximal aligning plate 541 and the distal aligning plate 542 use positions which are not in contact with a sheet when the sheet is conveyed to the intermediate processing tray 540 as home positions. The home positions are detected by a proximal aligning plate home sensor S772 (FIG. 5) and a distal aligning plate home sensor S773 (FIG. 5) and are also positions where the finisher 500 is positioned when it is not operated. Further, when a sheet is conveyed by the rocking guide portion 50 (FIG. 2), the proximal aligning plate 541 and the distal aligning plate 542 move to preset and predetermined standby positions in response to a sheet size (length in the sheet conveyance direction and a length in the sheet width direction).

The stapler unit 510 is disposed to the end portion of the intermediate processing tray 540 on the upstream side thereof and subjects a sheet bundle to a staple process by driving a stapler clinch motor M760 (FIG. 5). Further, the stapler unit 510 is configured to be free to move in the sheet width direction and moved in the sheet width direction by a stapler slide motor M761 (FIG. 5). Further, the stapler unit 510 uses an end portion in the sheet width direction as a home position which is detected by a stapler home sensor S360 (FIG. 5). Note that the stapler unit 510 can also select staple positions of a sheet bundle such as a one-staple position and a two-staple position and moves to an actual staple position depending on set contents such as a sheet size, a stapling position, and the like and executes stapling at a predetermined position.

The stacking portion 52 includes a stack tray 504 as a sheet stacking portion, a trailing end aligning wall 570, and a puddle 583. The stack tray 504 is disposed to a downstream side of the sheet processing portion 51, and a sheet (sheet bundle) having been subjected to the post process by the sheet processing portion 51 is stacked on the stack tray 504.

The trailing end aligning wall 570 is disposed to an end portion of the stack tray 504 on the upstream side thereof as well as below the rocking roller 550 and is supported rockably about an aligmnent shaft 572. Further, a driven roller 571 is rotatably supported by an upper end of the trailing end aligning wall 570, and when the rocking arm 551 is rocked down, the driven roller 571 forms a nip together with the rocking roller 550. Note that the driven roller 571 and the rocking roller 550 configure a moving portion for moving a sheet (sheet bundle) to the stack tray 504. Further, the trailing end aligning wall 570 is attached with a tensile spring 512 which is urged in a direction where the trailing end aligning wall 570 is rocked to the upstream side. Further, the trailing end aligning wall 570 is driven by and coupled with a trailing end aligning wall rocking motor M755 which rocks the trailing end aligning wall 570. Note that the trailing end aligning wall 570 uses a position illustrated in FIG. 2 as a home position which is detected by a trailing end aligning wall home sensor S775 (FIG. 5).

The puddle 583 is disposed to an end portion of the stack tray 504 on the upstream side thereof. The puddle 583 is elastically deformably formed and connected to a rotating shaft 590 in a radiation direction. Rotating the puddle 583 once counterclockwise about the rotating shaft 590 by rotating a puddle rotation motor M756 causes the sheet (sheet bundle) conveyed to the stack tray 504 to move toward the trailing end aligning wall 570 and to be aligned in the sheet conveyance direction. Note that the puddle 583 uses a position illustrated in FIG. 2 as a home position which is detected by a puddle home sensor S774 (FIG. 5).

Figure 4:
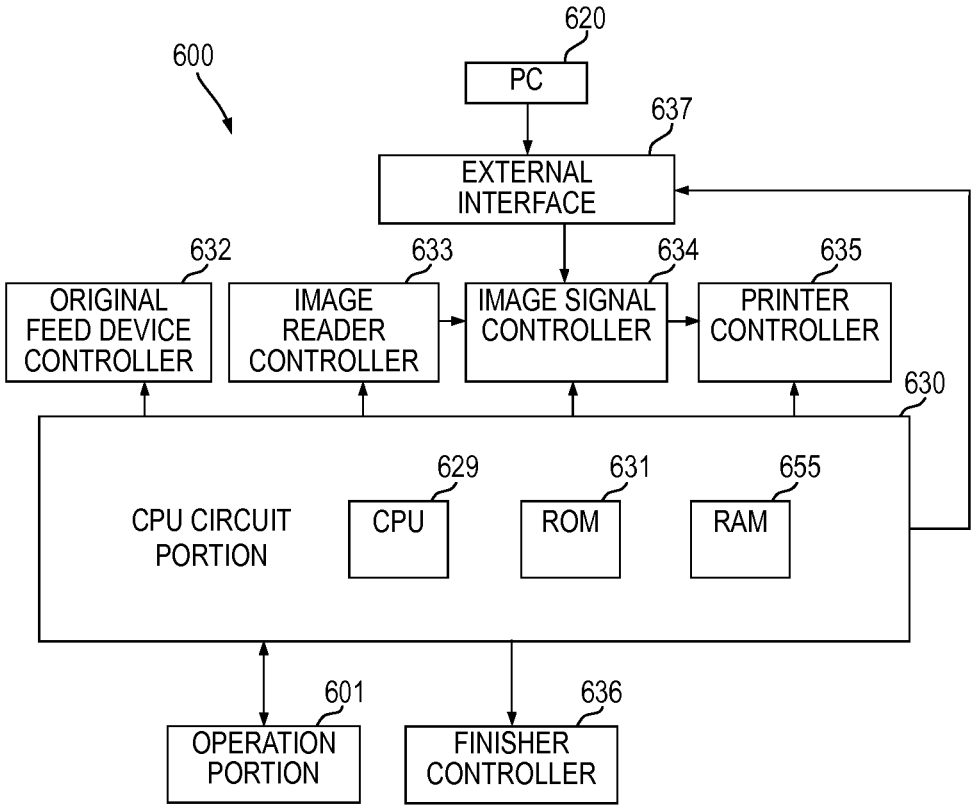
FIG. 4 is a block diagram of a controller of the image forming apparatus according to the embodiment.

Next, a controller 600 of the image forming apparatus 1 will be described referring to FIG. 4 and FIG. 5. FIG. 4 is a block diagram of the controller 600 of the image forming apparatus 1 according to the embodiment. FIG. 5 is a block diagram of a finisher controller 636 for controlling the finisher 500 according to the embodiment.

As illustrated in FIG. 4, the controller 600 includes a CPU circuit portion 630, an original feed apparatus controller 632, an image reader controller 633, an image signal controller 634, a printer controller 635, and a finisher controller 636 as a controller.

The CPU circuit portion 630 includes a CPU 629, a ROM 631, and a RAM 655. The CPU 629 controls the original feed apparatus controller 632, the image reader controller 633, the image signal controller 634, the printer controller 635, and the finisher controller 636 according to a program stored in the ROM 631 and to a setting that is input from an operation portion 601. The RAM 655 is used as a region for temporarily holding control data and as a work area for executing an arithmetic operation necessary to control.

The original feed apparatus controller 632 controls the original feed apparatus 101, and the image reader controller 633 controls the scanner unit 104 for reading information of an original fed from the original feed apparatus 101, the image sensor 109, and the like (refer to FIG. 1). The data of the original read by the image reader controller 633 is output to the image signal controller 634. The printer controller 635 controls the apparatus main body 200. An external interface 637 connects an external computer 620 to the apparatus main body 200 and develops print data input from, for example, the external computer (PC) 620 to an image and outputs the image to the image signal controller 634. The image data output to the image signal controller 634 is output to the printer controller 635, and an image is formed by the image forming portion 201.

The finisher controller 636 is mounted on the finisher 500, controls various drive motors and sensors illustrated in FIG. 5 while transmitting and receiving information to and from the CPU circuit portion 630, and controls a drive of the finisher 500 in its entirety. As illustrated in FIG. 5, the finisher controller 636 includes a CPU 701, a RAM 702, a ROM 703, a network interface 704, a communication interface 706, a conveyance controller 707, an intermediate processing tray controller 708, a staple controller 709, and the like. An input port of an input/output portion (I/O) 705 of the finisher controller 636 is input with a sensor signal from equipment connected to the CPU 701, the network interface 704, and the communication interface 706. In contrast, an output port of the input/output portion (I/O) 705 is connected to the conveyance controller 707, the intermediate processing tray controller 708, and the staple controller 709 and outputs a predetermined signal to respective drive systems of the conveyance controller 707, the intermediate processing tray controller 708, and the staple controller 709.

The conveyance controller 707 controls the sheet position detecting sensor S770 and the conveying motor M750 to thereby execute a conveyance control of a sheet conveyed to the finisher 500. The intermediate processing tray controller 708 controls a drive of the respective home sensors and the respective motors to thereby control a movement of the proximal aligning plate 541 and the distal aligning plate 542, controls a drive of the return belt 560, controls a rocking of the rocking arm 551, and controls a rotation of the rocking roller 550. Likewise, the intermediate processing tray controller 708 controls a rocking of the trailing end aligning wall 570 and a rotation of the puddle 583. The staple controller 709 controls the stapler home sensor S360, the stapler clinch motor M760, and the stapler slide motor M761 to thereby execute a stapler slide control and a staple clinch operation control.

Next, a sheet discharge process executed by the finisher 500 according to the embodiment will be described referring to FIGS. 6A to 6C to FIG. 12. In the embodiment, the sheet discharge process will be described using an operation of a discharge process for discharging a B4 size sheet (hereinafter, called "B4 sheet") which is used as a reference sheet and a B5 size sheet (hereinafter, called "B5 sheet") having a length in the conveyance direction shorter than the B4 sheet. That is, in the embodiment, the sheet discharge process will be described setting the length of the B4 sheet in the sheet conveyance direction as a predetermined length in the sheet conveyance direction and using the B4 sheet and the B5 sheet shorter than the predetermined length in the sheet conveyance direction. Ordinarily, the user takes out a sheet stacked on the stack tray 504 from a proximal side of the image forming apparatus 1 facing the operation portion 601 for executing various inputs/settings to the image forming apparatus 1. Hereinafter, a description will be made assuming that one proximal end side of both the ends of the stack tray 504 in the sheet width direction orthogonal to the sheet conveyance direction acts as a sheet take-out port.

Figure 6A:
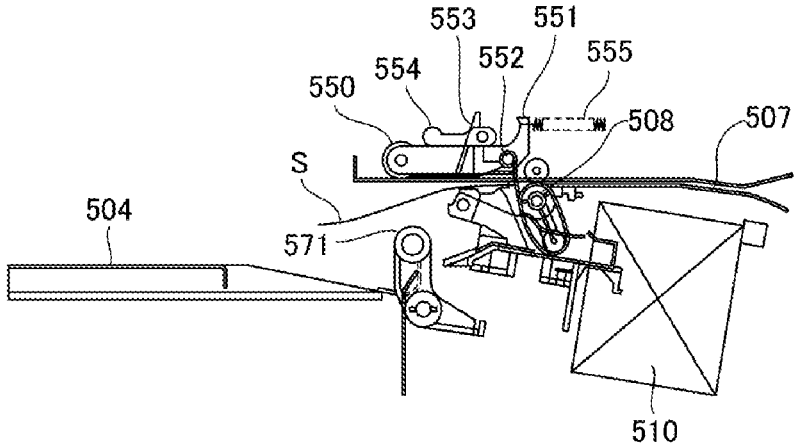
FIGS. 6A to 6C are views illustrating a state that a B5 sheet is conveyed to a processing tray of the finisher.
Figure 6B:
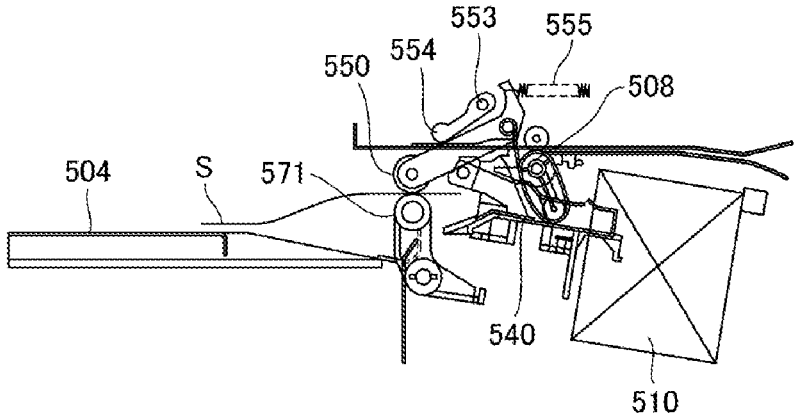
Figure 6C:
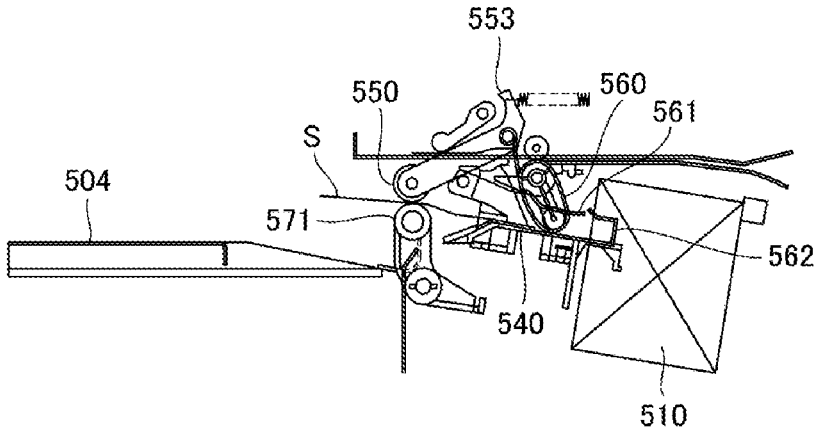
Figure 7A:
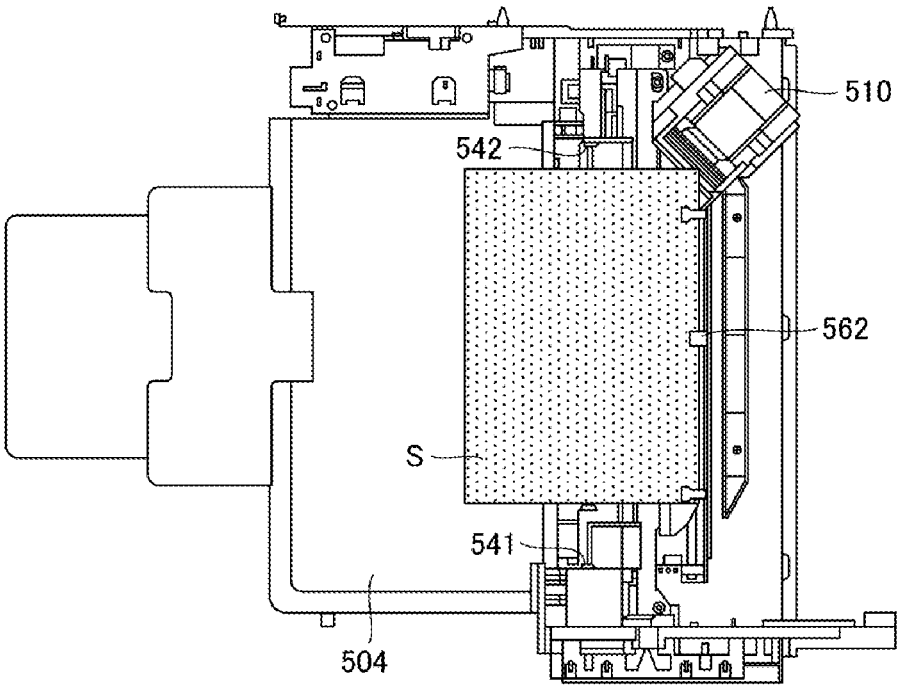
FIGS. 7A and 7B are views illustrating a state that the B5 sheet is aligned in a sheet width direction on the processing tray.
Figure 7B:
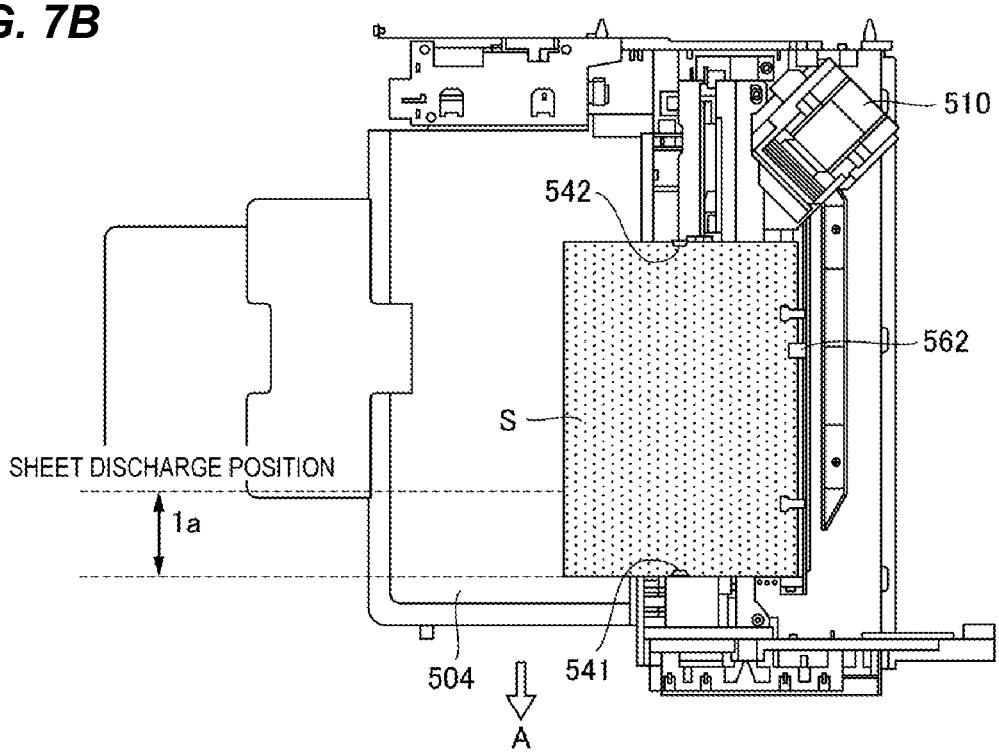
Figure 8A:
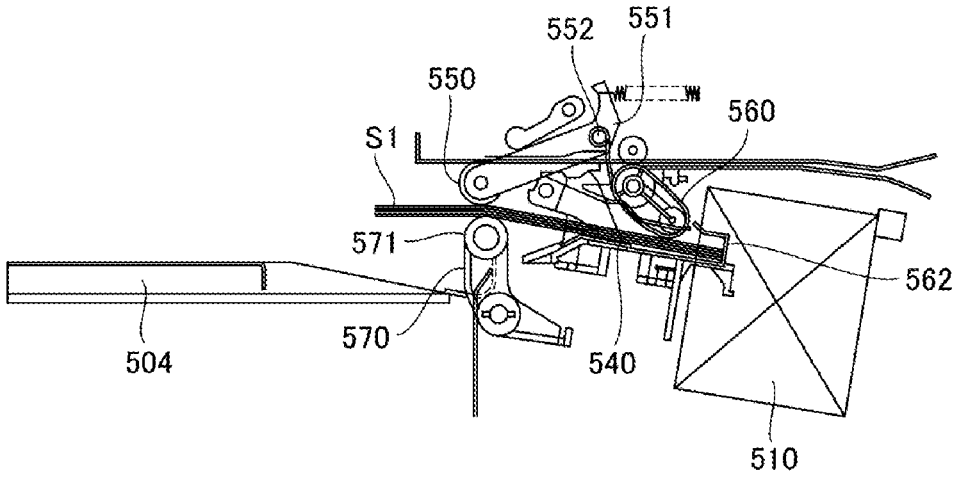
FIGS. 8A and 8B are views illustrating a state that a B5 sheet bundle is conveyed from the processing tray to a stack tray.
Figure 8B:
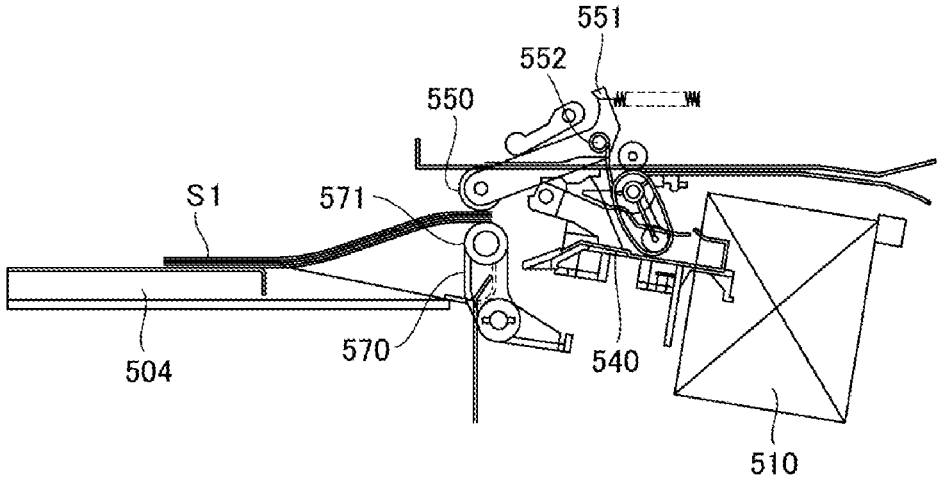
Figure 9A:
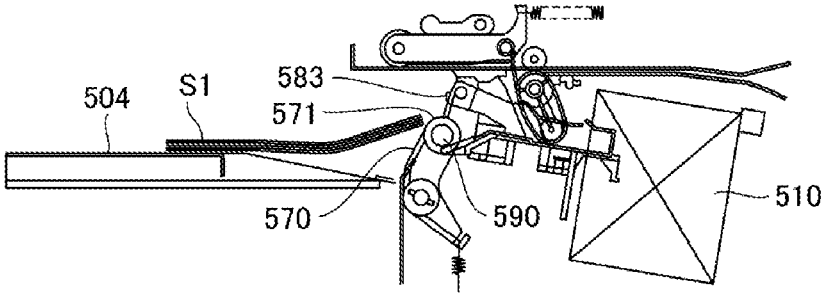
FIGS. 9A to 9C are views illustrating a state that a B5 sheet bundle is aligned in a sheet conveyance direction on the stack tray.
Figure 9B:
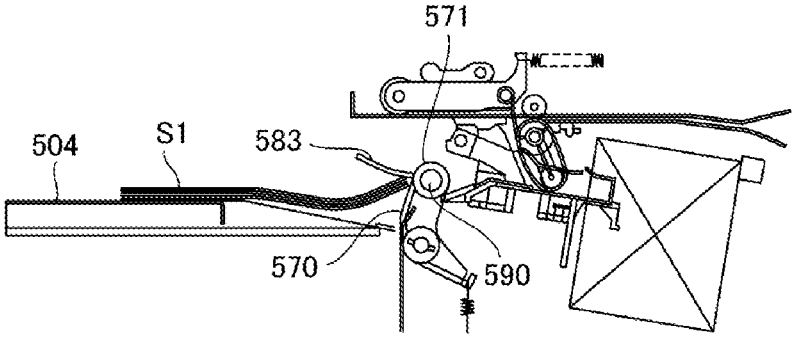
Figure 9C:
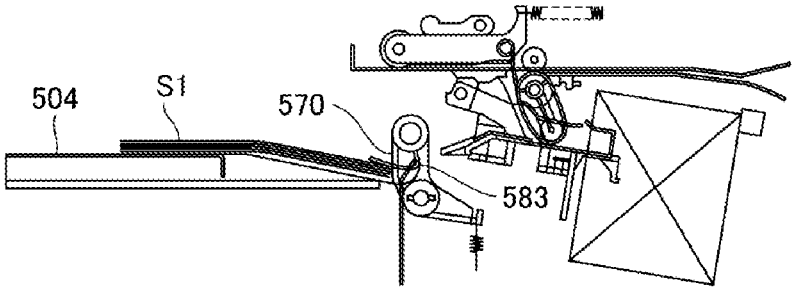

First, a sheet discharging operation for discharging a sheet bundle S1 of plural B5 sheets (hereinafter, called "B5 sheet bundle") which have been aligned at a second position shifted from a sheet discharge position to the take-out port side by a first interval 1*a* will be described referring to FIGS. 6A to 6C to FIGS. 9A to 9C. FIGS. 6A to 6C are views illustrating a state that a B5 sheet S is conveyed to the intermediate processing tray 540 of the finisher 500. FIGS. 7A and 7B are views illustrating a state that the B5 sheet bundle S1 is aligned in the sheet width direction on the intermediate processing tray 540. FIGS. 8A and 8B are views illustrating a state that the B5 sheet bundle S1 is conveyed from the intermediate processing tray 540 to the stack tray 504. FIGS. 9A to 9C are views illustrating a state that the B5 sheet bundle S1 is aligned on the stack tray 504 in the sheet conveyance direction.

As illustrated in FIG. 6A, the B5 sheet S discharged from the apparatus main body 200 is conveyed toward the stack tray 504 by the discharge roller 508 and a driven roller disposed to the conveying path 507. When the B5 sheet S has been discharged from the discharge roller 508, the rocking arm 551 is rocked counterclockwise about the rocking shaft 552 in FIG. 6A by being driven by the rocking arm drive motor M751. As illustrated FIG. 6B, rocking the rocking arm 551 counterclockwise causes the rocking roller 550 to move down, thereby the B5 sheet S is fallen down by pressing a trailing end portion of the B5 sheet S by the rocking roller 550. When the rocking roller 550 moves down while falling down the B5 sheet S, the rocking roller 550 forms the nip together with the driven roller 571 and the B5 sheet S is held by the nip.

Next, as illustrated in FIG. 6C, the rocking roller 550 is rotated counterclockwise by being driven by the rocking roller drive motor M752. The rocking roller 550 is rotated until a trailing end of the B5 sheet S is abutted against the return belt 560 and the B5 sheet S is drawn toward the upstream side along a lower guide. When the trailing end of the B5 sheet S has been abutted against the return belt 560, the return belt 560 causes the B5 sheet S to abut against the trailing end stopper 562, thereby the B5 sheet S is aligned in the sheet conveyance direction. Thereafter, the rocking roller 550 is moved upward up to the home position again by rocking the rocking arm 551 upward to prepare to discharge a next B5 sheet S.

Upon completion of alignment in the sheet conveyance direction on the intermediate processing tray 540, the B5 sheet S is aligned in the sheet width direction at a second position shifted from a first position to be described later to the take-out port side (proximal side) A by the first interval 1*a*. As illustrated in FIG. 7A, when the B5 sheet S is discharged, the proximal aligning plate 541 and the distal aligning plate 542 wait at preset and predetermined standby positions. As illustrated in FIG. 7B, the B5 sheet is aligned in the width direction by causing the proximal aligning plate 541 to wait at the position shifted from the sheet discharge position to the take-out port side A by the first interval 1*a* and moving the distal aligning plate 542 to the take-out port side A and abutting the distal aligning plate 542 against the B5 sheet. With the operation, the B5 sheet is aligned at the second position shifted from the sheet discharge position to the take-out port side A by the first interval 1*a*. The alignment operations in the sheet conveyance direction and in the sheet width direction described above are repeatedly executed each time a B5 sheet S is conveyed until a job is finished, thereby the B5 sheet bundle S1 is formed.

As illustrated in FIG. 8A, when the B5 sheet bundle S1 has been formed at the second position on the intermediate processing tray 540, the rocking arm 551 is rocked counterclockwise in FIG. 8A by being driven by the rocking arm drive motor M751 and the rocking roller 550 is moved downward. The rocking roller 550 forms the nip together with the driven roller 571 and the B5 sheet bundle S1 is held by the nip. As illustrated in FIG. 8B, when the B5 sheet bundle S1 is held, the rocking roller 550 is rotated clockwise by being driven by the rocking roller drive motor M752, the B5 sheet bundle S1 is conveyed until a trailing end thereof reaches the vicinity of an upper end of the trailing end aligning wall 570 and stopped. Thereafter, the rocking roller 550 is caused to be away from the B5 sheet bundle S1 and returned to the home position.

As illustrated in FIG. 9A, when the rocking roller 550 has been returned to the home position, the rocking roller 550 is rocked to the upstream side of the trailing end aligning wall 570 by driving the trailing end aligning wall rocking motor M755, thereby an upstream end of the B5 sheet bundle S1 is abutted against a slant surface of the trailing end aligning wall 570. As illustrated in FIG. 9B, when the upstream end of the B5 sheet bundle S1 has been abutted against the slant surface, the trailing end aligning wall 570 is returned to the home position, so that the upstream end of the B5 sheet bundle S1 is pressed to the trailing end aligning wall 570 in an approximately horizontal direction by returning the trailing end aligning wall 570. With the operation, as illustrated in FIG. 9C, the B5 sheet bundle S1 can be stacked on the stack tray 504 while aligning the upstream end of the B5 sheet bundle S1. At the time, rotating the puddle 583 once (refer to FIG. 9B) causes the B5 sheet bundle S1 to be drawn back to the upstream side so that the B5 sheet bundle S1 is abutted against the trailing end aligning wall 570 as well as to be pressed by the puddle 583 from its upper surface to prevent the B5 sheet bundle S1 from being disturbed (refer to FIG. 9C).

Figure 10A:
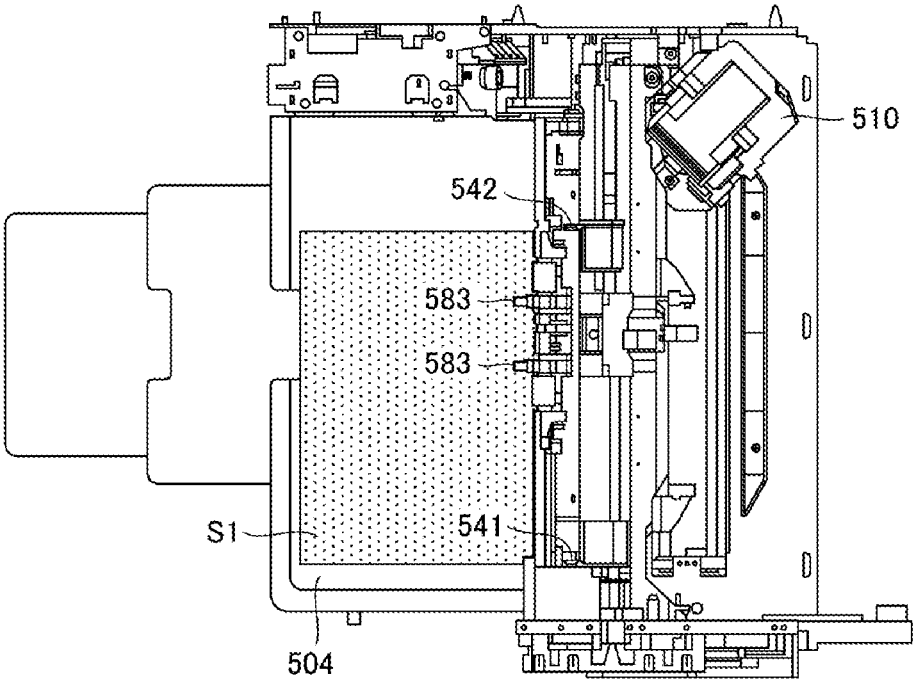
FIGS. 10A and 10B are views illustrating a state that a B5 sheet bundle is aligned in a shifted state with a B5 sheet bundle conveyed onto the stack tray in the sheet width direction.
Figure 10B:
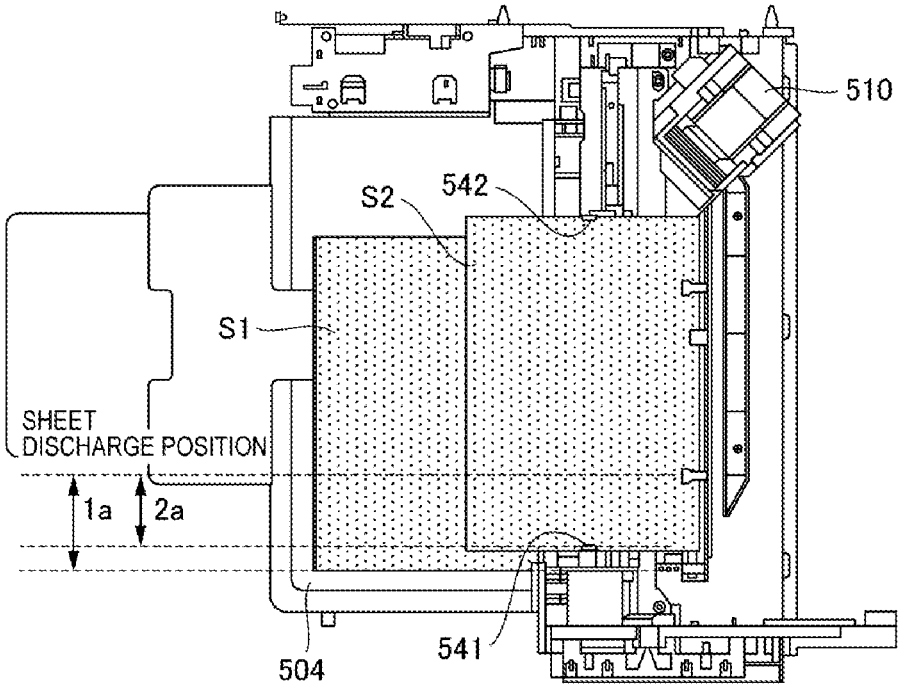

Next, a sheet discharging operation for discharging a B5 sheet bundle S2 which has been aligned at a third position shifted from the sheet discharge position to the take-out port side by a second interval 2*a* shorter than the first interval 1*a* (in a state that the B5 sheet bundle S2 has been sorted to a B5 sheet bundle S1) referring to FIGS. 10A and 10B. FIGS. 10A and 10B are views illustrating a state that a B5 sheet bundle S2 is aligned in a sorted state with a B5 sheet bundle S1 conveyed to the stack tray 504 in the sheet width direction. Note that since an operation for conveying a sheet conveyed from the apparatus main body 200 onto the intermediate processing tray 540 and an operation for discharging a sheet bundle formed on the intermediate processing tray 540 to the stack tray 504 are the same as those of the B5 sheet bundle S1 described above, a description thereof is omitted.

To sort and align the B5 sheet bundle S2 to and with the B5 sheet bundle S1 illustrated in FIG. 10A at the second interval 2*a*, as illustrated in FIG. 10B, first, the proximal aligning plate 541 is caused to wait at a position shifted from the sheet discharge position to the take-out port side by the second interval 2*a*. Note that distances from the sheet discharge position at the time are first interval 1*a*>second interval 2*a*. Further, the second interval 2*a* is a preset interval and allocated when sheets having the same size such as the B5 sheets are aligned in a sorted state. The second interval 2*a* is allocated when, for example, each predetermined number of sheets (for example, each one sheet) having the same size is shifted and ejected.

When the B5 sheet has been conveyed onto the intermediate processing tray 540, the B5 sheet is aligned in the sheet width direction by moving the distal aligning plate 542 to the take-out port side. The alignment operation of the B5 sheet bundle S2 in the sheet conveyance direction is repeatedly executed each time a B5 sheet is conveyed until a final sheet of a job is conveyed, thereby the B5 sheet bundle S2 is formed. Thereafter, the B5 sheet bundle S2 is discharged to the stack tray 504 by a sheet bundle discharging operation similar to that of the B5 sheet bundle S1. With the operation, the B5 sheet bundle S2 aligned at the third position is stacked on the stack tray 504 while being sorted from the B5 sheet bundle S1 located at the second position nearer to the take-out port (one end) side. Although the third position is farther from the take-out port (one end) side than the second position, it is nearer to the take-out port (one end) side than the first position to be described later.

Figure 11A:
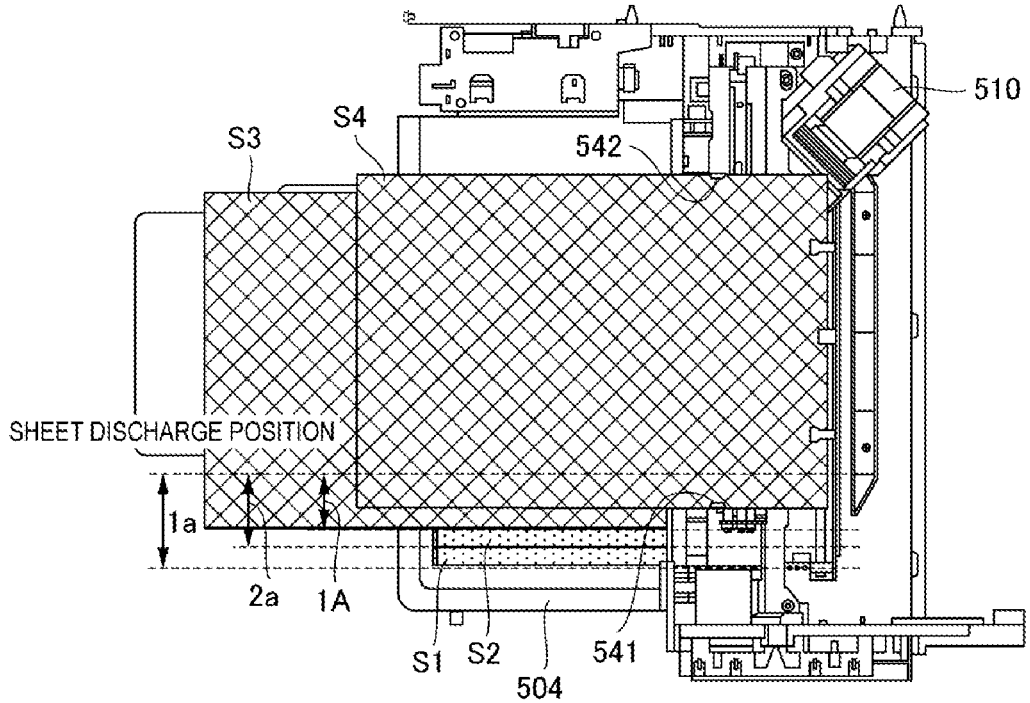
FIGS. 11A and 11B are views illustrating a state that a B4 sheet is aligned in a state shifted with a B5 sheet bundle stacked on the stack tray in the sheet width direction.
Figure 11B:
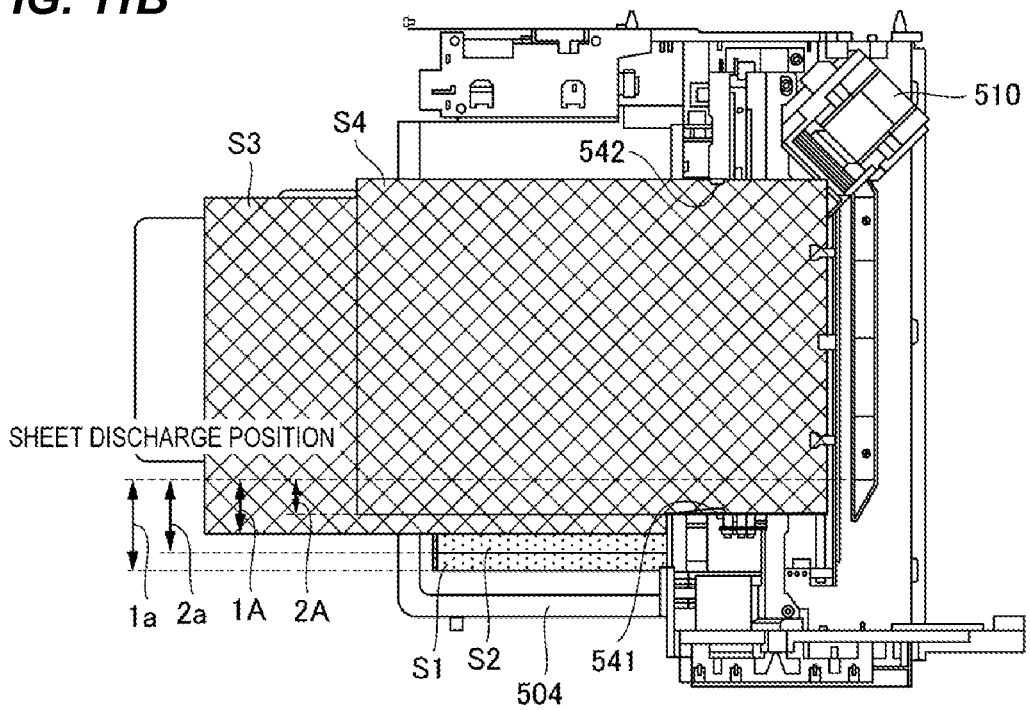

Next, a sheet discharging operation for discharging a B4 sheet having a length in the sheet conveyance direction as long as or (longer than) the reference sheet to the B5 sheet bundle S1 and the B5 sheet bundle S2 discharged onto the stack tray 504 will be described referring to FIGS. 11A and 11B. FIGS. 11A and 11B are views illustrating a state that a B4 sheet bundle S3 is aligned in a shifted state with a B5 sheet bundle S2 stacked on the stack tray 504 in the sheet width direction. Note that since an operation for conveying a sheet conveyed from the apparatus main body 200 onto the intermediate processing tray 540 and an operation for discharging a sheet aligned on the intermediate processing tray 540 to the stack tray 504 are the same as those described above, a description thereof is omitted.

Since the B4 sheet has a length in the sheet conveyance direction equal to or more than the reference sheet, the B4 sheet is discharged onto the stack tray 504 after it is aligned at the first position positioned inside of the second position and the third position. To align a B4 sheet bundle S3 with a B5 sheet bundle S1 and a B5 sheet bundle S2 illustrated in FIG. 11A at the first position, first, the proximal aligning plate 541 is caused to wait at a preset position shifted from the sheet discharge position to the take-out port side by a third interval 1A. Note that distances from the sheet discharge position to the take-out port side at the time are first interval 1*a*>second interval 2*a*>third interval 1A, and the third interval 1A is a preset interval allocated when a sheet acting as the reference sheet such as the B4 sheet of the embodiment is aligned.

When the B4 sheet has been conveyed onto the intermediate processing tray 540, the B4 sheet is aligned in the sheet width direction by moving the distal aligning plate 542 to the proximal side. An alignment operation of the B4 sheet bundle S3 is repeatedly executed each time a B4 sheet is conveyed until a final sheet of a job is conveyed and the B4 sheet bundle S3 is formed. Thereafter, the B4 sheet bundle S3 is discharged to the stack tray 504 by a sheet bundle discharging operation similar to that of the B5 sheet bundle S1. With the operation, the B4 sheet bundle S3 is discharged onto the stack tray 504 in a state that it is positioned inside of the B5 sheet bundle S1 and the B5 sheet bundle S2.

Figure 12:
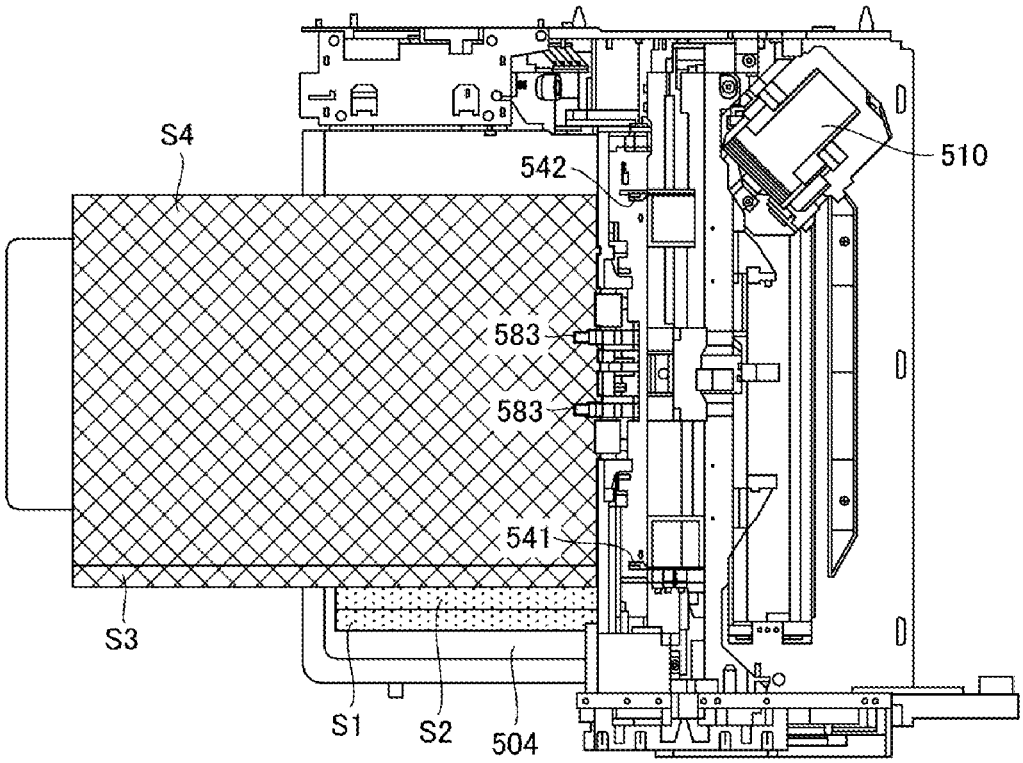
FIG. 12 is a view illustrating a state that a B4 sheet shifted from a B4 sheet stacked on the stack tray is stacked on the stack tray.

Next, a sheet discharging operation for aligning a B4 sheet S4 at a fourth position shifted from the sheet discharge position to the take-out port side by a fourth interval 2A shorter than the third interval lA (in a state that the B4 sheet bundle S4 has been sorted to a B4 sheet bundle S3) and discharging the B4 sheet S4 will be described referring to FIG. 12 in addition to FIGS. 11A and 11B. FIG. 12 is a view illustrating a state that a B4 sheet S4 shifted from a B4 sheet bundle S3 stacked on the stack tray 504 is stacked on the stack tray 504. Note that since an operation for conveying a sheet conveyed from the apparatus main body 200 onto the intermediate processing tray 540 and an operation for discharging a sheet aligned on the intermediate processing tray 540 to the stack tray 504 are the same as those described above, a description thereof is omitted.

To sort and align the B4 sheet S4 to and with the B4 sheet bundle S3 illustrated in FIGS. 11A and 11B at a fourth interval 2A, first, the proximal aligning plate 541 is caused to wait at a predetermined position where shifted from the sheet discharge position to the proximal side by the fourth interval 2A. Note that distances from the sheet discharge position at the time is first interval 1*a*>second interval 2*a*>third interval 1A>fourth interval 2A, and third interval>fourth interval. When the B4 sheet S4 has been conveyed onto the intermediate processing tray 540, the B4 sheet S4 is aligned in the sheet width direction by moving the distal aligning plate 542 to the take-out port side A. Thereafter, the B4 sheet S4 is discharged to the stack tray 504 by a sheet bundle discharging operation similar to that of the B4 sheet bundle S3 (refer to FIG. 12).

Figure 13:
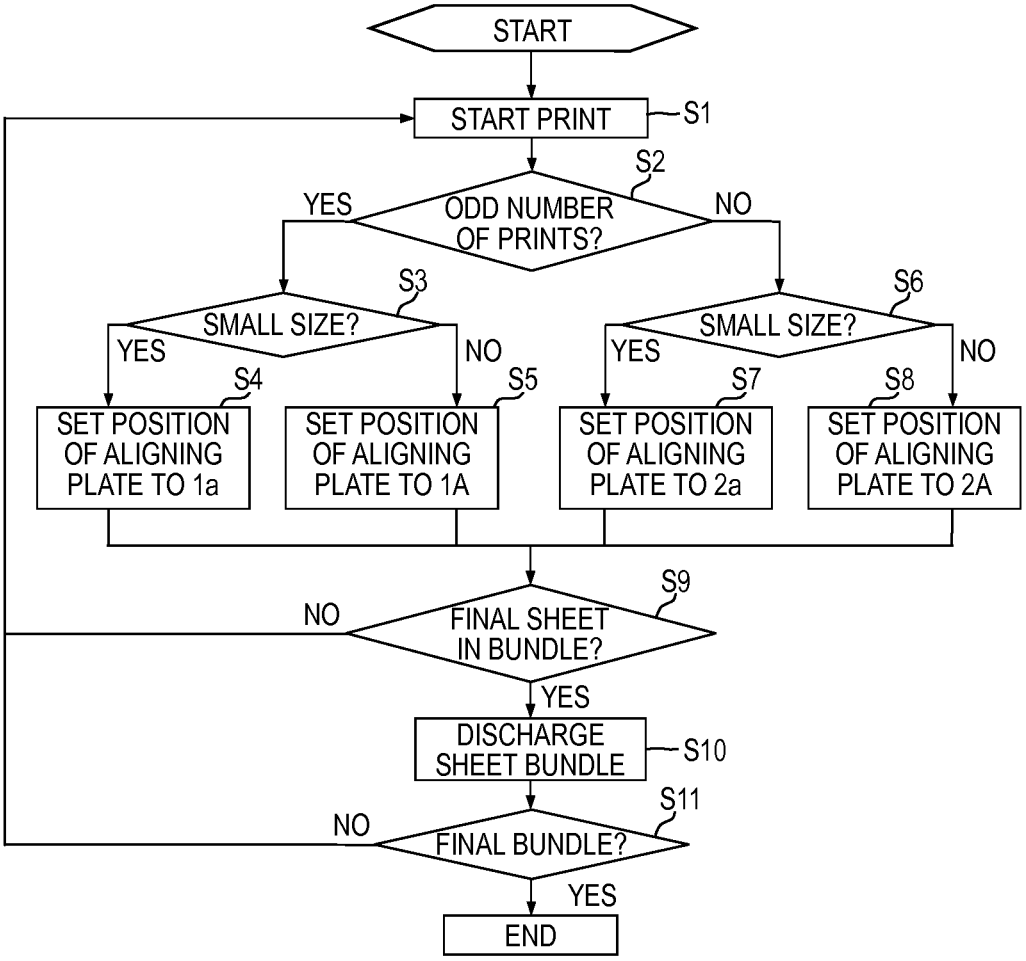
FIG. 13 is a flowchart illustrating an alignment process executed by the finisher when a print job of the image forming apparatus according to the embodiment is executed.

Next, a sheet sorting operation executed by the image forming apparatus 1 according to the embodiment will be described according to a flowchart of FIG. 13. FIG. 13 is a flowchart illustrating an alignment process executed by the finisher 500 when a print job is executed by the image forming apparatus 1 according to the embodiment. Note that, in the following description, when the B4 size sheet is set as a reference size sheet, a sheet having a length in the sheet conveyance direction shorter than the B4 size sheet is called a small-sized sheet, and a sheet having a length in the sheet conveyance direction longer than the B4 size sheet is called a large-sized sheet.

When, for example, the sorting process is selected by the operation portion 601, as illustrated in FIG. 13, the image forming process (print) described above is started (step S1) after an initializing operation of the image forming apparatus 1 has been executed. On the completion of the image forming process (print), when a job is an odd number job and the B5 size (small sheet) is set by the operation portion 601, an alignment is executed by causing the proximal aligning plate 541 to wait at a position shifted from the sheet discharge position to the proximal side by the first interval 1*a* (steps S2 to S4). In contrast, when the job is the odd number job and the B4 size (large size) is set by the operation portion 601, the alignment is executed by causing the proximal aligning plate 541 to wait at a position shifted from the sheet discharge position to the proximal side by the third interval 1A (steps S2, S3, S5).

Further, when the job is not the odd number job, i.e., an even number job and the B5 size is set by the operation portion 601, the alignment is executed by causing the proximal aligning plate 541 to wait at a position shifted from the sheet discharge position to the proximal side by the second interval 2*a* (steps S2, S6, S7). In contrast, when the job is the even number job and the B4 size (large size) is set by the operation portion 601, the alignment is executed by causing the proximal aligning plate 541 to wait at a position shifted from the sheet discharge position to the proximal side by the fourth interval 2A (steps S2, S6, S8).

When a discharged sheet is a final sheet in a bundle, the sheet bundle is discharged onto the stack tray 504, whereas when the discharged sheet is not the final sheet in the bundle, a next print job will be executed (steps S9, S10). The operation is repeated up to a final bundle, and when the final bundle has been processed, the job is finished (step S11).

As described above, the finisher 500 aligns a sheet having a length shorter than a sheet having the preset reference size in the sheet conveyance direction at a position shifted to the take-out port side by a predetermined interval than a sheet having a length equal to or longer than the length of the reference sheet in the sheet conveyance direction. In other words, a sheet or a sheet bundle having a short length in a sheet discharging direction is controlled so as to be aligned at a position near to the take-out port side. For example, the B5 sheet bundle S1 and the B4 sheet bundle S3 are aligned so that the end portion of one end side of the B5 sheet bundle S1 on the proximal side of the stack tray 504 is stacked at a position nearer to the one end side of the B4 sheet bundle S3 than the end portion of one end side thereof. Accordingly, even when, for example, other sheet or sheet bundle (for example, the B4 sheet bundle) having a size larger than a sheet or sheet bundle (for example, the B5 sheet bundle) discharged earlier is discharged later, it can be easily recognized visually that the sheet exists. Further, a previously discharged sheet can be prevented from not being visually recognized by being covered with other sheet discharged later. As a result, a visual recognition property of a sheet can be improved.

Further, when a discharged sheet or sheet bundle is taken out, it can be taken out by holding a shifted portion thereof without removing or dislocating other sheet or sheet bundle. Accordingly, a take-out property of a sheet or a sheet bundle can be also improved. Further, an alignment property of the other sheet or sheet bundle at the time can be prevented from being disturbed.

Further, in the embodiment, intervals between plural sheets at the time the plural sheets are subjected to the sorting process are set so that intervals between sheets having a different size are set larger than intervals between sheets having the same size. Accordingly, even in a shift process of sheets having a different size, a visual recognition property of plural sheets can be prevented from being deteriorated by that the plural sheets are covered with other sheet.

Further, executing the alignment process described above on the intermediate processing tray 540 allows the alignment operation described above to be executed without executing the alignment process by, for example, newly providing a pair of alignment members with the stack tray 504, thereby a cost can be suppressed.

Although the embodiment of the invention has been described, the invention is not limited to the embodiment described above. Further, only most preferable effects resulting from the invention are exemplified in the effects described in the embodiment of the invention and the effects according to the invention are not limited to those described in the embodiment.

For example, the embodiment has been described using the case that the B4 sheet having the predetermined length in the sheet conveyance direction is set as the reference sheet and the B4 sheet and the B5 sheet are discharged, the invention is not limited thereto. When, for example, the B4 sheet is set as the reference sheet, although the A3 sheet is aligned at the first position because it has the length in the sheet conveyance direction longer than the B4 sheet, the A4 sheet is aligned at the second position because it has the length in the sheet conveyance direction shorter than the B4 sheet. When, for example, the A4 sheet is set as the reference sheet, although the A3 sheet and the B4 sheet are aligned at the first position because they have the length in the sheet conveyance direction longer than the A4 sheet, the A5 sheet is aligned at the second position because it has the length in the sheet conveyance direction shorter than the A4 sheet.

Further, the embodiment has been described using the case that the B4 sheet having the predetermined length in the sheet conveyance direction as the reference sheet and the alignment is executed at the first position and at the second position, the invention is not limited thereto. For example, plural reference sheets having a predetermined length in the sheet conveyance direction may be set and plural sort positions may be set to each of the set plural reference sheets.

Further, although the embodiment has been described using the sheet which is placed with its longitudinal direction in parallel with the sheet conveyance direction, the invention is not limited thereto. The invention can be also applied even to a case that a sheet is placed with its longitudinal direction orthogonal to the sheet conveyance direction. In the case, it is sufficient to align a sheet having a smaller size (sheet having a shorter length in the sheet width direction orthogonal to the sheet conveyance direction) at a position nearer to the proximal side.

Further, although the embodiment has been described using the proximal aligning plate 541 and the distal aligning plate 542, the invention is not limited thereto. For example, the rocking roller 550 may be configured to be able to move in the sheet width direction to cause a sheet to shift in the sheet width direction.

Further, in the embodiment, although an aligned sheet bundle is moved onto the stack tray 504 after sheets have been aligned on the intermediate processing tray 540, the invention is not limited thereto. For example, sheets may be directly discharged onto the stack tray 504 and may be aligned on the stack tray 504.

Although the embodiment has been described using the image forming apparatus including the sheet processing apparatus integrated with the image forming apparatus main body, the invention is not limited thereto. For example, the sheet processing apparatus may be detachably mounted on the image forming apparatus main body.

Further, in the embodiment, although the finisher controller 636 is mounted on the finisher 500 that is controlled by the CPU circuit portion 630 which is mounted on the apparatus main body 200 and to which the finisher 500 is on-line connected, the invention is not limited thereto. For example, the finisher controller 636 may be mounted on the apparatus main body 200 integrally with the CPU circuit portion 630 and the finisher 500 may be controlled from the apparatus main body 200 side.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-142189 filed Jun. 25, 2012, which is hereby incorporated by reference herein in its entirety.

What is claimed is:

1. A sheet stacking apparatus, comprising:

a recognizing unit which recognizes a length of a sheet in a sheet conveying direction;

a shifting portion which shifts a sheet in a sheet width direction intersecting the sheet conveying direction;

a stacking portion on which a plurality of sheets shifted by the shifting portion are stacked, the sheets having different lengths in the sheet conveying direction, the sheets stacked on the stacking portion being removed in a take-out direction parallel to the sheet width direction; and a controller which controls the shifting portion such that, when the length of a sheet recognized by the recognizing unit is equal to or greater than a predetermined length, the sheet is stacked on a first position of the stacking portion, and which controls the shifting portion such that, when the length of a sheet recognized by the recognizing unit is less than the predetermined length, the sheet is stacked on a second position of the stacking portion, wherein, with respect to the take-out direction, an edge of a sheet stacked on the second position extends further than an edge of a sheet stacked on the first position.

2. The sheet stacking apparatus according to claim 1, further comprising:

a second stacking portion on which a sheet is stacked; and a discharging portion which discharges a sheet stacked on the second stacking portion onto the stacking portion, wherein the shifting portion includes an aligning portion which aligns a plurality of sheets stacked on the second stacking portion and the shifting portion shifts the plurality of sheets in the width direction.

3. The sheet stacking apparatus according to claim 2, further comprising a stapling portion which staples a plurality of sheets aligned by the aligning portion.

4. The sheet stacking apparatus according to claim 1, further comprising:

a second stacking portion on which a sheet shifted by the shifting portion is stacked;

a stapling portion which staples sheets stacked on the stacking portion; and a discharging portion which discharges a bundle of sheets stapled by the stapling portion.

5. The sheet stacking apparatus according to claim 1, further comprising a stapling portion which staples sheets shifted by the shifting portion.

6. The sheet stacking apparatus according to claim 1, wherein the stacking portion is disposed under a reading portion which reads an image of an original.

7. The image forming apparatus according to claim 1, wherein an edge of a sheet, in the take-out direction, stacked on the first position is parallel to an edge of a sheet, in the take-out direction, stacked on the second position.

8. An image forming apparatus, comprising:

an image forming portion which forms an image on a sheet;

a recognizing unit which recognizes a length of a sheet in a sheet conveying direction,. on which sheet an image is formed by the image forming portion;

a shifting portion which shifts a sheet in a sheet width direction intersecting the sheet conveying direction;

a stacking portion on which a plurality of sheets shifted by the shifting portion are stacked, the sheets having different lengths in the sheet conveying direction, the sheets stacked on the stacking portion being removed in a take-out direction parallel to the sheet width direction; and a controller which controls the shifting portion such that, when the length of a sheet recognized by the recognizing unit is equal to or greater than a predetermined length, the sheet is stacked on a first position of the stacking portion, and which controls the shifting portion such that, when the length of a sheet recognized by the recognizing unit is less than the predetermined length, the sheet is stacked on a second position of the stacking portion, wherein, with respect to the take-out direction, an edge of a sheet stacked on the second position extends further than an edge of a sheet stacked on the first position.

9. The image forming apparatus according to claim 8, further comprising:

a second stacking portion on which a sheet is stacked; and a discharging portion which discharges a sheet stacked on the second stacking portion onto the stacking portion, wherein the shifting portion includes an aligning portion which aligns a plurality of sheets stacked on the second stacking portion and the shifting portion shifts the plurality of sheets in the width direction.

10. The image forming apparatus according to claim 9, further comprising a stapling portion which staples a plurality of sheets aligned by the aligning portion.

11. The image forming apparatus according to claim 8, further comprising:

a second stacking portion on which a sheet shifted by the shifting portion is stacked;

a stapling portion which staples sheets stacked on the stacking portion; and a discharging portion which discharges a bundle of sheets stapled by the stapling portion.

12. The image forming apparatus according to claim 8, further comprising a stapling portion which staples sheets shifted by the shifting portion.

13. The image forming apparatus according to claim 8, further comprising a reading portion which reads an image of an original, the reading portion being disposed above the stacking portion.

14. The image forming apparatus according to claim 8, wherein an edge of a sheet, in the take-out direction, stacked on the first position is parallel to an edge of a sheet, in the take-out direction, stacked on the second position.

15. An image forming apparatus, comprising:

an image forming portion which forms an image on a sheet;

a recognizing unit which recognizes a length of a sheet in a sheet conveying direction, on which sheet an image is formed by the image forming portion;

a shifting portion which shifts a sheet in a sheet width direction intersecting the sheet conveying direction;

a stacking portion on which a plurality of sheets shifted by the shifting portion are stacked, the sheets having different lengths in the sheet conveying direction, the sheets stacked on the stacking portion being removed from a front side of the image forming apparatus; and a controller which controls the shifting portion such that, when the length of a sheet recognized by the recognizing unit is equal to or greater than a predetermined length, the sheet is stacked on a first position of the stacking portion, and which controls the shifting portion such that, when the length of a sheet recognized by the recognizing unit is less than the predetermined length, the sheet is stacked on a second position of the stacking portion, the second position being closer to the front side than the first position in the sheet width direction.

16. The image forming apparatus according to claim 15, further comprising:

a second stacking portion on which a sheet is stacked; and a discharging portion which discharges a sheet stacked on the second stacking portion onto the stacking portion, wherein the shifting portion includes an aligning portion which aligns a plurality of sheets stacked on the second stacking portion and the shifting portion shifts the plurality of sheets in the width direction.

17. The image forming apparatus according to claim 16, further comprising a stapling portion which staples a plurality of sheets aligned by the aligning portion.

18. The image forming apparatus according to claim 15, further comprising:

a second stacking portion on which a sheet shifted by the shifting portion is stacked;

a stapling portion which staples a plurality of sheets stacked on the stacking portion; and a discharging portion which discharges a bundle of sheets stapled by the stapling portion.

19. The image forming apparatus according to claim 15, further comprising a stapling portion which staples sheets shifted by the shifting portion.

20. The image forming apparatus according to claim 15, further comprising a reading portion which reads an image of an original, the reading portion being disposed above the stacking portion.

21. The image forming apparatus according to claim 15, further comprising an operation portion which a user operates from the front side.

22. The image forming apparatus according to claim 21, wherein the recognizing unit recognizes the length of a sheet based on information inputted to the operation portion.

23. The image forming apparatus according to claim 15, wherein a front-side edge of a sheet stacked on the first position is parallel to a front-side edge of a sheet stacked on the second position.

* * * * *